United States Patent [19]

Sales et al.

[11] Patent Number: 4,659,000

[45] Date of Patent: Apr. 21, 1987

[54] CARRYING CASE FOR DUAL INSTRUMENTS

[75] Inventors: Wayne C. Sales, Sterling Heights; R. L. Thomasson, Troy, both of Mich.

[73] Assignee: K mart Corporation, Troy, Mich.

[21] Appl. No.: 841,941

[22] Filed: Mar. 20, 1986

[51] Int. Cl.[4] ..... A45F 5/00

[52] U.S. Cl. ..... 224/252; 224/269; 24/3 R

[58] Field of Search ..... 224/252, 152, 269, 235, 224/240; 368/276, 277, 278, 101; 24/3 E, 3 J, 3 R, 3 F, 3 L, 490, 512; 446/28

[56] References Cited

U.S. PATENT DOCUMENTS

| | | | |
|---|---|---|---|
| 1,952,307 | 3/1934 | Boucher | 368/277 |
| 3,719,037 | 3/1973 | Williams | 368/278 |

*Primary Examiner*—Stephen Marcus
*Assistant Examiner*—David Voorhees
*Attorney, Agent, or Firm*—Alexander, Unikel, Zalewa & Tenenbaum, Ltd.

[57] ABSTRACT

A compartmentized case for dual instrumentalities such as a compass and thermometer providing a recessed base and cover hinged together along corresponding end edges, and including a clasp-like structure for securing the case in either a closed or open condition upon a belt or other piece of wearing apparel.

13 Claims, 6 Drawing Figures

CARRYING CASE FOR DUAL INSTRUMENTS

BACKGROUND OF THE INVENTION

This invention relates to an improvement in a carrying case providing individual compartments for housing selected instruments, with the case having a construction whereby it may be readily attached to a support such as a belt or other edge portion of a user's wearing apparel. Furthermore, the construction of the case permits convenient pivoting of each portion of the case relative to each other and its support, so as to place the instrumentalities in either portion of the case in a line of sight of the user without detachment from its support.

Belt holders for watches or other instrumentalities such as that disclosed in U.S. Pat. No. 1,479,008, are well known in the art. However, these holders provide only one instrument support and are functional only to display the single instrument. See also U.S. Pat. No. 1,961,066; U.S. Pat. No. 2,509,428; and U.S. Pat. No. 3,214,685 for single instrument carrying cases.

Other highly complicated constructions relating to receptacles for watches and the like are shown in U.S. Pat. No. 1,201,332. This device has extensive internal linkage by which the instrument carried thereby, such as a watch as shown, is pivoted into a viewing position upon the opening of the case.

The present invention is simple in construction, economical to manufacture, and convenient to use.

SUMMARY OF THE INVENTION

A principle object of this invention is to provide a convenient carrying case for a plurality of instruments, with the case divided into separate compartments, one each in the cover and the base portions of the case.

The case, in addition to being compartmentized, provides a means for attachment to a belt or other article of apparel. This attachment means may consist of a clasp-like structure, hingedly attached to the case in such a manner that the case may be conveniently pivoted into selected positions relative to its attachment as well as to the support to which it is attached, so as to readily position, in a convenient line of sight, each or both instruments contained in the case without detachment from the support.

The case and its detachable clasp-like securing means are so constructed that in their closed position they will lie flat against the wearer in an inconspicuous manner, yet be readily available when the wearer wishes to inspect the instruments therein.

By the novel construction, hereinafter more fully described, the case provides a base to which is hingedly connected a cover. Both the base and cover are adapted to house separate instrumentalities such as a compass and a thermometer in such a manner that such portions of the case may be angularly positioned relative to each other with the instrumentalities in either the base or cover placed in an unobstructed line of sight.

BRIEF DESCRIPTION OF THE DRAWINGS

The invention will be best understood by reference to the accompanying drawings illustrating the preferred form of construction by which the objects of the invention are achieved, and in which.

GENERAL DESCRIPTION OF THE INVENTION

Figure 1:
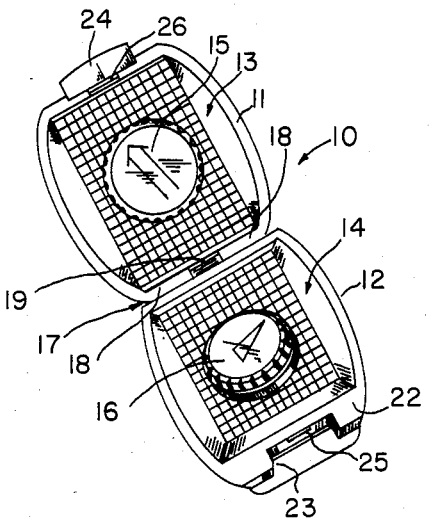
FIG. 1 is a perspective view of the case in an open condition showing the separate instrumentalities therein.

As clearly shown in the drawings, particularly FIG. 1, the case 10 comprises a cover 11 and a base 12 with each of them providing an internal compartment 13 and 14, respectively. Each of the compartments 13 and 14 are concaved so as to provide relieved areas that can receive the housings for the respective instrumentalities such as a compass 15 and a thermometer 16.

The cover 11 and base 12 are joined along one end edge by a hinge structure 17. This hinge structure 17 consists of a pair of spaced-apart hollow bosses 18 formed in a projecting peripheral flange 19 of the cover 11. A mating hollow boss 20 is formed on a corresponding edge of the base 12, such that when the hollow bosses 18 and 20 are placed in axial alignment, they will receive a hinge pin 21, thus completing the hinge structure 17.

Figure 4:
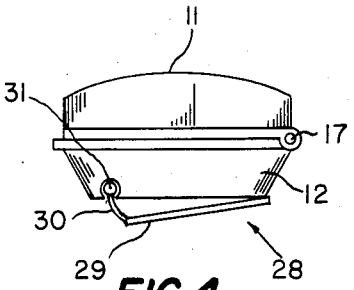
FIG. 4 is an end elevational view of the case in a closed position.
Figure 5:
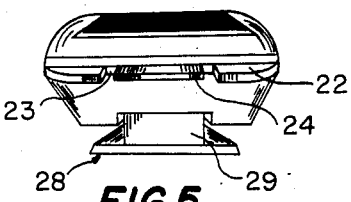
FIG. 5 is a side elevational view of the case in a closed position.

As shown in FIGS. 1 and 5, the base 12 provides a forwardly extending flange 22 that is recessed as at 23 to form a receptacle for a corresponding fingered tab 24 formed on the forward end of the peripheral flange of the cover 11. The fingered tab 24 is so designed and dimensioned that it will frictionally fit within the recess 23 so as to releasably latch the cover 11 onto the base 12 in a closed position as shown in FIGS. 4 and 5.

As shown in FIG. 1, the inner wall of the recess 23 has projecting therefrom a latch strip 25 that is adapted to be overridden by a latch keeper 26 provided by the trailing edge 27 of the fingered tab 24 of cover 11, when the cover 11 is pivoted into a position so as to close the case 10.

Figure 2:
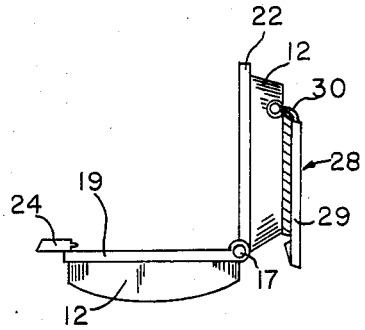
FIG. 2 is a side elevational view of the case in one open position, showing a support therefor in section.
Figure 3:
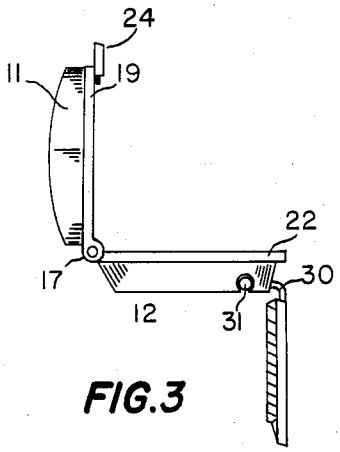
FIG. 3 is a side elevational view similar to FIG. 2 but showing the case in another of its open positions, with a support therefor in section.
Figure 6:
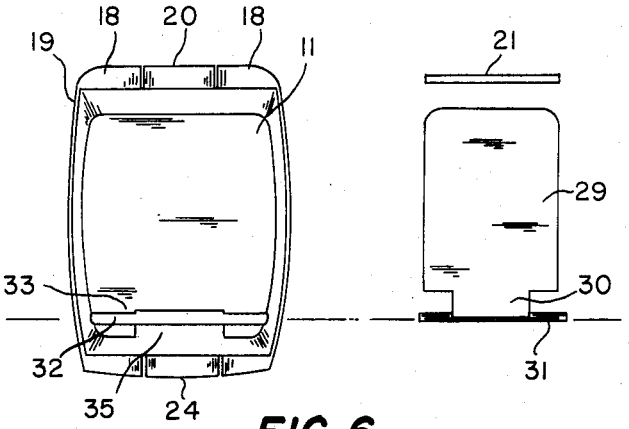
FIG. 6 is a bottom plan view showing the clasp-like attaching member in an exploded relation.

A clasp-like structure 28 is provided by which the case 10 may be removably mounted in a supported position upon a belt or other edge portion of apparel. This clasp-like structure 28 consists of a relatively thin rectangularly-shaped body 29 that has a reduced arcuated extension 30 extending upwardly and out of the normal plane of the body 29. This extension 30 terminates into an elongated integral circular transverse rod 31. The circular rod 31 is adapted to be slidably frictionally fitted into a circular recess 32 formed on the underside 33 of the base 12. As shown in FIGS. 2 and 3, the clasp may be projected beyond a belt 34 or any other edge portion of the apparel of the user of the instrument, in such a position that the case 10 may be pivoted into varying positions placing the compartments 13 and 14 into a convenient line of sight.

To permit full pivotal movement of the case relative to the secured clasp-like structure 28, the forward edge portion of the underside 33 of the base 12 is notched as at 35 so as to accommodate the arcuated extension 29 when the case is placed in the position as shown in FIG. 3.

When it is desirable to view the compass 15 contained in the cover 11, the wearer will merely insert a finger beneath the fingered tab 24 of the cover 11 and exert outward pull upon the same. This movement will cause the cover 11 to pivot about the hinge structure 17 while the base 12 is retained by the clasp-like structure 28 upon the belt 31 as viewed in FIG. 2. The finger pressure will be sufficient to withdraw the latch keeper 26 off the latch strip 25, thus permitting the case to be opened.

In the event the user wishes to view the thermometer 16 as housed in the base 12, all that need be done is to then pivot the base 12 about the transverse rod 31 of the hinge structure 17 away from the belt 31 and into the position shown in FIG. 3. In the event that the article is not to be carried, the clip-like structure 28 may be readily removed merely by sliding the circular rod 31 out of the circular recess 32 formed in the underside 33 of the base 12. In such a condition, the device may conveniently be placed and sit upon a flat surface.

It is, of course, understood that it is within the spirit of this invention to modify or change the above specifically described structure within the scope of the claims, in order to adapt the device to various designs and material which may be used, and to any other desired articles which are to be carried by a person and held in a convenient place for ready inspection.

We claim:

1. A portable dual compartmentized case for housing separate instrumentalities comprising:

(a) a base providing an internal compartment for housing an independent instrumentality;

(b) a cover hinged to said base and providing an internal compartment for housing a second independent instrumentality;

(c) hinge means connecting said cover to said base along corresponding edges thereof;

(d) a clasp means for the case for removably attaching the case to a case positioning support;

(e) hinge means provided by said clasp means hingedly connecting said clasp means to said base along a line adjacent to one bottom edge thereof at an edge opposite to said corresponding hinged edges of said base and said cover; and (f) means provided by said base along said line adjacent to said one bottom edge thereof for removably receiving said hinge means of said clasp means whereby said clasp means by movement along said line is removed from said base.

2. A dual compartmentized case as defined by claim 1, wherein said support means comprises a clasp-like member having a width and length substantially equal to the bottom of said base, with said clasp-like structure providing an arcuated connecting neck and an integral connecting pin adapted to be removably attached to the underside of said base adjacent to one end edge thereof.

3. A dual compartmentized case as defined by claim 1, wherein the hinge means connecting said cover to said base comprises hollow bosses formed integrally with said base and said cover along one edge thereof, with said bosses horizontally aligned so as to receive therein a hinge pin by which the cover is hingedly connected to said base.

4. A dual compartmentized case as defined by claim 3, wherein said clasp means comprises a clasp-like member having a width and length substantially equal to the bottom of said base, with said clasp-like structure providing an arcuated neck terminating into an integral hinge pin adapted to be removably attached to the underside of said base adjacent to said connecting means for said clasp means.

5. A dual compartmentized case as defined by claim 1 wherein said supporting means comprises a clasp-like structure having a substantial flat, rectangularly shaped body, and providing at one end edge thereof with an arcuated neck terminating into an elongated hinge member, the length of which equals the width of the body, said means connecting said clasp means to said base providing means on the underside of said base for slidably receiving and pivotally retaining said hinge member so as to pivotally connect said clasp-like structure to said case.

6. A dual compartmentized case as defined by claim 5 wherein the hinged means connecting said cover to said base comprises hollow bosses formed intregrally with said base and said cover along one edge thereof, with said bosses horizontally aligned so as to receive therein said hinge member provided at the end of said arcuated neck provided by said flat body of the clasp-like structure.

7. A dual compartmentized case as defined by claim 1, wherein said means connecting said clasp means to said base includes a circular recess transversing the bottom of said base adjacent one edge thereof which is adapted to hingedly received said clasp means.

8. A dual compartmentized case as defined by claim 2, wherein said means connecting said clasp means to said base includes a circular recess transversing the bottom of said base adjacent one edge thereof which is adapted to hingedly received said clasp means.

9. A dual compartmentized case as defined by claim 1 wherein said base and said cover are recessed to a depth sufficient to contain therein a raised housing for each of said separate instrumentalities with the housings of each instrumentality of a like size so as to be facially mated when the case is placed in a closed position upon the base.

10. A dual compartmentized case as defined by claim 9 wherein said clasp means comprises a clasp-like member having a width and length substantially equal to the bottom of said base, with said clasp-like structure providing an arcuated connecting neck and an integral connecting pin adapted to be removably attached to the underside of said base adjacent to one end edge thereof.

11. A dual compartmentized case as defined by claim 9 wherein the hinge means connecting said cover to said base comprises hollow bosses formed integrally with said base and said cover along one edge thereof, with said bosses horizontally aligned so as to receive therein a hinge pin by which the cover is hingedly connected to said base.

12. A dual compartmentized case as defined by claim 5 wherein said base and said cover are recessed to a depth sufficient to contain therein a raised housing for each of said separate instrumentalities with the housings of each instrumentality of a like size so as to be facially mated when the case is placed in a closed position upon the base.

13. A dual compartmentized case as defined by claim 6 wherein said base and said cover are recessed to a depth sufficient to contain therein a raised housing for each of said separate instrumentalities with the housings of each instrumentality of a like size so as to be facially mated when the case is placed in a closed position upon the base.

* * * * *